US010968838B2

(12) United States Patent
Shimomura et al.

(10) Patent No.: US 10,968,838 B2
(45) Date of Patent: Apr. 6, 2021

(54) ENGINE SPEED CONTROL DEVICE

(71) Applicant: Yanmar Co., Ltd., Osaka (JP)

(72) Inventors: Ryosuke Shimomura, Osaka (JP); Ryota Iwano, Osaka (JP); Tomoaki Morita, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 0 days.

(21) Appl. No.: 16/616,392

(22) PCT Filed: Mar. 26, 2018

(86) PCT No.: PCT/JP2018/012165
§ 371 (c)(1),
(2) Date: Nov. 22, 2019

(87) PCT Pub. No.: WO2018/216344
PCT Pub. Date: Nov. 29, 2018

(65) Prior Publication Data

US 2020/0232396 A1 Jul. 23, 2020

(30) Foreign Application Priority Data

May 23, 2017 (JP) ..... JP2017-102138

(51) Int. Cl.
*F02D 41/02* (2006.01)
*F02D 45/00* (2006.01)
(Continued)

(52) U.S. Cl.
CPC ..... *F02D 1/04* (2013.01); *F02D 41/3005* (2013.01); *F02D 2200/021* (2013.01);
(Continued)

(58) Field of Classification Search
CPC ..... F02D 1/04; F02D 41/02; F02D 41/3005; F02D 2200/06; F02D 2200/021; F02D 2200/023; F02D 2200/101
See application file for complete search history.

(56) References Cited

U.S. PATENT DOCUMENTS

2009/0248282 A1* 10/2009 Adachi ..... F02N 11/0818 701/112
2017/0138249 A1* 5/2017 Petillon ..... F02D 41/40

FOREIGN PATENT DOCUMENTS

JP 04-159437 A 6/1992
JP 2009-036180 A 2/2009
(Continued)

OTHER PUBLICATIONS

International Search Report dated May 1, 2018 issued in corresponding PCT Application PCT/JP2018/012165.

*Primary Examiner* — Phutthiwat Wongwian
*Assistant Examiner* — Arnold Castro
(74) *Attorney, Agent, or Firm* — Norton Rose Fulbright US LLP

(57) ABSTRACT

An engine speed control device performing: a first PID gain calculation step of calculating a target engine speed to thereby calculate a first PID gain based on an engine speed deviation between the target engine speed and an engine speed; a target rack position calculation step of correcting the first PID gain based on a cooling water temperature to thereby calculate a target rack position of a fuel injection pump; a second PID gain calculation step of calculating a second PID gain based on a rack position deviation between the target rack position and a rack position; and a rack control signal producing step of correcting the second PID gain based on a lubricating oil temperature to thereby produce a rack control signal. The engine speed control
(Continued)

device thus controls an engine speed by controlling the rack position based on the rack control signal.

2 Claims, 8 Drawing Sheets

(51) Int. Cl.
*F02D 1/04* (2006.01)
*F02D 41/30* (2006.01)

(52) U.S. Cl.
CPC .... *F02D 2200/023* (2013.01); *F02D 2200/06* (2013.01); *F02D 2200/101* (2013.01)

(56) References Cited

FOREIGN PATENT DOCUMENTS

| | | | |
|---|---|---|---|
| JP | 2010-222989 | A | 10/2010 |
| JP | 2010-229874 | A | 10/2010 |
| JP | 2011-196333 | A | 10/2011 |
| JP | 2014-098397 | A | 5/2014 |

* cited by examiner

FIG. 5 map1

| | ΔN | | | | | | | | | | | | |
|---|---|---|---|---|---|---|---|---|---|---|---|---|---|
| | ΔN(min) | · | · | · | · | ΔN(x) | · | · | · | · | · | · | ΔN(max) |
| Nm | Nm(0) | · | · | · | · | · | · | · | · | · | · | · | · |
| | · | · | · | · | · | · | · | · | · | · | · | · | · |
| | · | · | · | · | · | · | · | · | · | · | · | · | · |
| | · | · | · | · | · | · | · | · | · | · | · | · | · |
| | Nm(x) | · | · | · | · | · | · | · | · | K1p(x) K1i(x) K1d(x) | · | · | · |
| | · | · | · | · | · | · | · | · | · | · | · | · | · |
| | · | · | · | · | · | · | · | · | · | · | · | · | · |
| | Nm(max) | · | · | · | · | · | · | · | · | · | · | · | · |

FIG. 6 map2

| Tw | Tw(min) | * | * | * | Tw(x) | * | * | * | * | * | Tw(max) |
|---|---|---|---|---|---|---|---|---|---|---|---|
| ε1 (P, I, D) | ε1p(min)<br>ε1i(min)<br>ε1d(min) | * | * | * | ε1p(x)<br>ε1i(x)<br>ε1d(x) | * | * | * | * | * | ε1p(max)<br>ε1i(max)<br>ε1d(max) |

FIG. 7 map3

| | ΔR | | | | | | | | | | | |
|---|---|---|---|---|---|---|---|---|---|---|---|---|
| | ΔR(min) | | | | ΔR(x) | | | | | | | ΔR(max) |
| Rset | Rset(0) | | | | | | | | | | | |
| | | | | | | | | | | | | |
| | | | | | | | | | | | | |
| |

FIG. 8 map4

| Tp | Tp(min) | • | • | • | • | Tp(x) | • | • | • | • | • | Tp(max) |
|---|---|---|---|---|---|---|---|---|---|---|---|---|
| ε2 (P, I, D) | ε2p(min)<br>ε2i(min)<br>ε2d(min) | • | • | • | • | ε2p(x)<br>ε2i(x)<br>ε2d(x) | • | • | • | • | • | ε2p(max)<br>ε2i(max)<br>ε2d(max) |

ENGINE SPEED CONTROL DEVICE

CROSS REFERENCES TO RELATED APPLICATIONS

This application is a national stage application pursuant to 35 U.S.C. § 371 of International Application No. PCT/JP2018/012165, filed on Mar. 26, 2018 which claims priority under 35 U.S.C. § 119 to Japanese Patent Application No. 2017-102138 filed on May 23, 2017, the disclosures of which are hereby incorporated by reference in their entireties.

TECHNICAL FIELD

The present invention relates to an engine speed control device capable of appropriately controlling an engine speed even in a cold state.

BACKGROUND ART

An engine speed control device for controlling an engine speed calculates a deviation of an actual engine speed from a target engine speed, changes a parameter for increasing and reducing the engine speed in accordance with the amount of the deviation, such as a fuel injection amount, and executes feedback control of causing the actual engine speed to match with the target engine speed.

As a typical technique for the feedback control, PID control is widely known. The PID control is constituted by a proportional operation (P operation) of changing a control signal to be input to a device in proportion to the deviation of an actual value from a target value, an integration operation (I operation) of changing an input signal in proportion to a time integral value of the deviation, and a differentiation operation (D operation) of changing an input signal in proportion to a time derivative value of the deviation. These operations are executed in accordance with a PID gain.

As a proposed technique in the case of applying the PID control described above to an engine speed control device, since an engine operation is affected by a cold/hot state of the engine, a correction factor is set in accordance with the temperature of the engine, a preset PID gain is multiplied by the correction factor for correction, and the corrected PID gain is applied to engine speed control. This technique is intended to perform control in accordance with the engine temperature accordingly so that stability of the engine speed can be enhanced (see, for example, Patent Literature 1: PTL 1).

As another proposed technique, to detect a cold/hot state of an engine and reflect the state on PID control of the engine speed control device more finely, a cooling water temperature of an engine is detected in addition to a lubricating oil temperature, a correction factor corresponding to a temperature deviation between the lubricating oil temperature and the cooling water temperature is calculated, a PID gain is corrected by multiplying a PID gain by the correction factor, and the corrected PID gain is applied to engine speed control (see, for example, Patent Literature 2: PTL 2).

CITATION LIST

Patent Literature

PTL 1: Japanese Patent Application Laid-Open No. 2009-036180

PTL 2: Japanese Patent Application Laid-Open No. 2010-222989

SUMMARY OF INVENTION

Technical Problem

In the engine speed control devices of PTLs 1 and 2 described above, the cold/hot state of the engine is reflected on PID control of the engine speed so that engine speed control in a cold state can be stabilized to some degree. In some cases of engine speed control in the cold state, however, the engine speed cannot be stabilized even with the techniques described in PTLs 1 and 2, and the measures described above are not always sufficient.

Applicant has intensively studied in order to further stabilize engine speed control of an engine in a cold state to find that, in the case of adjusting the fuel injection amount by an operation of a rack of a fuel injection pump, operation responsiveness of the rack is affected by the cold/hot state of the engine and causes a disturbance of the engine speed.

Some aspects of the present invention have been made in view of the foregoing circumstances, and have a main technical issue of providing an engine speed control device capable of causing an engine speed of an engine to converge to a target speed quickly, independently of a cold/hot state of the engine.

Solution to Problem

To solve the main technical problems described above, some aspects of the present invention provide an engine speed control device for an engine, and the engine speed control device at least includes: an engine speed detecting means that detects an engine speed of the engine; a cooling water temperature detecting means that detects a temperature of a cooling water of the engine; a rack position detecting means that detects a rack position of a fuel injection pump; and a lubricating oil temperature detecting means that detects a lubricating oil temperature of the engine, wherein the engine speed control device performs a first PID gain calculation step of calculating a target engine speed to calculate a first PID gain based on an engine speed deviation between the target engine speed and an engine speed detected by the engine speed detecting means, a target rack position calculation step of correcting the first PID gain based on a cooling water temperature detected by the cooling water temperature detecting means to thereby calculate a target rack position of the fuel injection pump, a second PID gain calculation step of calculating a second PID gain based on a rack position deviation between the target rack position and a rack position detected by the rack position detecting means, and a rack control signal producing step of correcting the second PID gain based on a lubricating oil temperature detected by the lubricating oil temperature detecting means to thereby produce a rack control signal, and the engine speed control device controls the engine speed by controlling the rack position based on the rack control signal.

More preferably, the lubricating oil temperature detecting means is disposed in a fuel injection pump and detects a lubricating oil temperature of the fuel injection pump.

Advantageous Effects of Invention

The engine speed control device according to an embodiment of the present invention performs a first PID gain calculation step of calculating a target engine speed to calculate a first PID gain based on an engine speed deviation between the target engine speed and an engine speed detected by the engine speed detecting means, a target rack position calculation step of correcting the first PID gain based on a cooling water temperature detected by the cooling water temperature detecting means to thereby calculate a target rack position of the fuel injection pump, a second PID gain calculation step of calculating a second PID gain based on a rack position deviation between the target rack position and a rack position detected by the rack position detecting means, and a rack control signal producing step of correcting the second PID gain based on a lubricating oil temperature detected by the lubricating oil temperature detecting means to thereby produce a rack control signal. The engine speed control device controls the engine speed by controlling the rack position based on the rack control signal. Accordingly, a PID gain based on a rack position deviation is corrected based on a lubricating oil temperature of the engine and the corrected PID gain is used for PID control of the engine speed so that followability of the rack position relative to a target rack position of the fuel injection pump can be enhanced, and an actual engine speed of the engine speed can easily converge to a target engine speed.

In addition, the lubricating oil temperature detecting means is disposed in a fuel injection pump and detects a lubricating oil temperature of the fuel injection pump. With this configuration, a lubricating oil temperature of the fuel injection pump directly affecting operation responsiveness of the rack of the fuel injection pump is reflected in PID control as an actual lubricating oil temperature of the engine. Thus, higher stability of engine speed control can be obtained.

BRIEF DESCRIPTION OF DRAWINGS

FIG. 5 A first gain map that is referred to in performing the control flow depicted in FIG. 4.

FIG. 6 A water temperature correction map that is referred to in performing the control flow depicted in FIG. 4.

FIG. 7 A second gain map that is referred to in performing the control flow depicted in FIG. 4.

FIG. 8 A lubricating oil correction map that is referred to in performing the control flow depicted in FIG. 4.

DESCRIPTION OF EMBODIMENTS

An engine speed control device configured according to an embodiment of the present invention will be described hereinafter with reference to the drawings.

Figure 1:
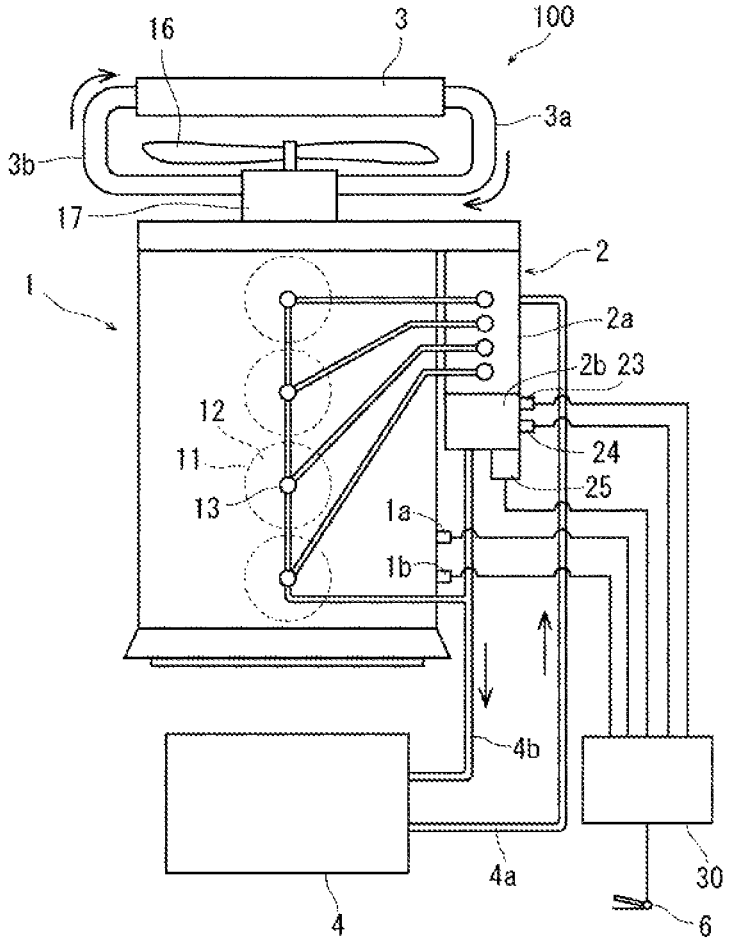
FIG. 1 A schematic drawing of an engine to which an engine control device according to an aspect of the present invention is applied.

FIG. 1 schematically illustrates a four-cylinder diesel engine 100 to which an engine speed control device according to this embodiment is applied. The diesel engine 100 is applicable to, for example, a ride-on agricultural vehicle or a ride-on mower, and is used not only as a power source for traveling but also as a power source for driving a work machine mounted thereon.

The diesel engine 100 includes at least an engine body 1 and a fuel injection pump 2. A radiator 3 for cooling cooling water of the engine is connected to the engine body 1 through cooling water passages 3*a* and 3*b*. A fuel tank 4 for storing fuel is also connected to the engine body 1 through a fuel supply passage 4*a*, the fuel injection pump 2, and a fuel return passage 4*b*, for example. Fuel that has overflowed is returned to the fuel tank 4. The fuel supply passage 4*a* is provided with a feed pump (not shown) for pumping fuel to the fuel injection pump 2.

The engine body 1 includes four cylinders 11 (indicated by dots), and a piston 12 capable of sliding upward and downward is disposed in each of the cylinders 11. The cylinder 11, the upper surface of the piston 12, and an unillustrated cylinder head define a fuel chamber, a front end of a fuel injection nozzle 13 is disposed in the cylinder head to face the fuel chamber so that fuel supplied from the fuel pump 2 is injected at an appropriate timing, for example, a timing when the piston 12 reaches a vicinity of a compression top dead center. When fuel is supplied to a high-temperature and high-pressure combustion chamber space compressed by elevation of the piston 12, the fuel is self-ignited to press the piston 12 downward so that an unillustrated crankshaft coupled to the piston 12 is driven to rotate. A cylinder block constituting the engine body 1 includes a cooling water temperature detecting means (hereinafter referred to as a "water temperature sensor") 1*a* for detecting a cooling water temperature Tw of the engine and a lubricating oil temperature detecting means (engine oil temperature sensor) 1*b* for detecting a temperature of lubricating oil for lubricating an operating section in the engine body 1. The water temperature sensor 1*a* and the engine oil temperature sensor 1*b* are connected to a control means 30. The combustion chamber space is connected to an intake passage and an exhaust passage. Since these passages do not constitute an essential part of the invention, illustrations thereof are omitted.

Figure 2:
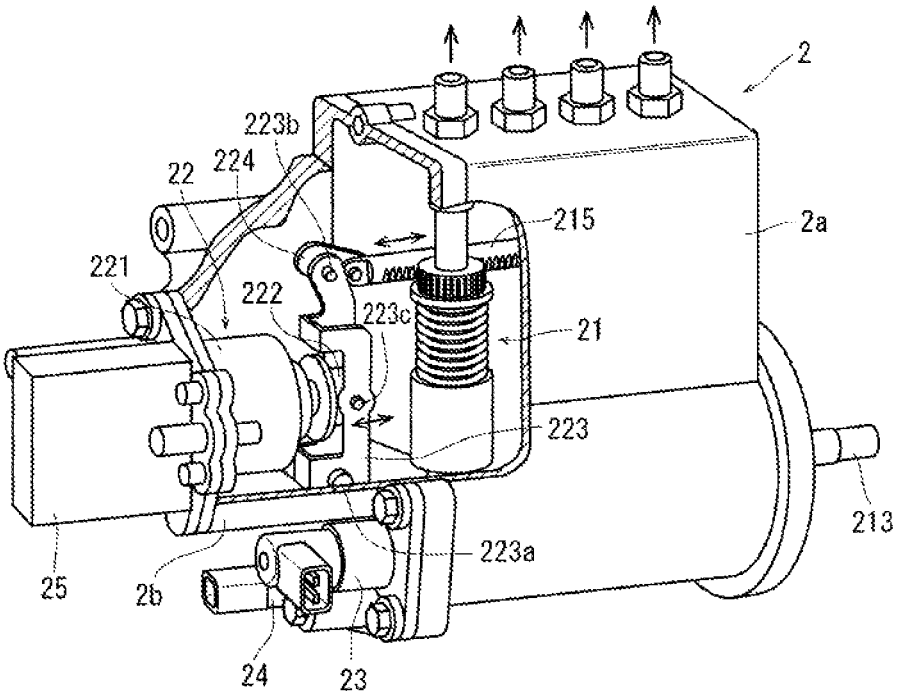
FIG. 2 A perspective view of a fuel injection pump applied to the engine illustrated in FIG. 1.

FIG. 2 illustrates a schematic perspective view of the fuel injection pump 2 constituting the diesel engine 100. The fuel injection pump 2 illustrated in FIG. 2 is a so-called in-line injection pump that pumps fuel to the fuel injection nozzle 13 disposed in each cylinder 11 by driving and rotation of a cam shaft 213 by the unillustrated crankshaft of the engine body 1. The fuel injection pump 2 mainly includes fuel pressurization mechanisms 21 and a governor mechanism 22. The fuel pressurization mechanisms 21 and the governor mechanism 22 are covered with a pump case 2*a* and a governor case 2*b*, respectively. The pump case 2*a* includes the fuel pressurization mechanisms 21 in the same number as the number of cylinders of the diesel engine 100. The governor case 2*b* includes the governor mechanism 22 for adjusting the amount of fuel discharged from the fuel pressurization mechanisms 21. The fuel injection pump 2 is provided with a pump oil temperature detecting means (hereinafter referred to as a pump oil temperature sensor") 23 for detecting an actual lubricating oil temperature in the fuel injection pump 2, and an engine speed detecting means (hereinafter referred to as an engine speed sensor) 24 for detecting an engine speed from a rotation speed of a cam shaft of the fuel injection pump 2. The operating section in the fuel injection pump 2 is supplied with lubricating oil distributed in the engine body 1 through unillustrated pipes, and the lubricating oil that has lubricated the inside of the fuel injection pump 2 is returned to the engine body 1. For convenience of description, in the fuel injection pump 2 illustrated in FIG. 2, the pump case 2*a* and the governor case 2*b* are partially cut out so that the inside of the fuel injection pump 2 can be seen. The location of the engine speed sensor is not limited to the inside of the fuel injection pump 2, and any known detection method, such as a detection method for detecting rotation of the unillustrated crankshaft of the engine body 1 or detecting vibrations generated by combustion, may be employed as appropriate.

Figure 3:
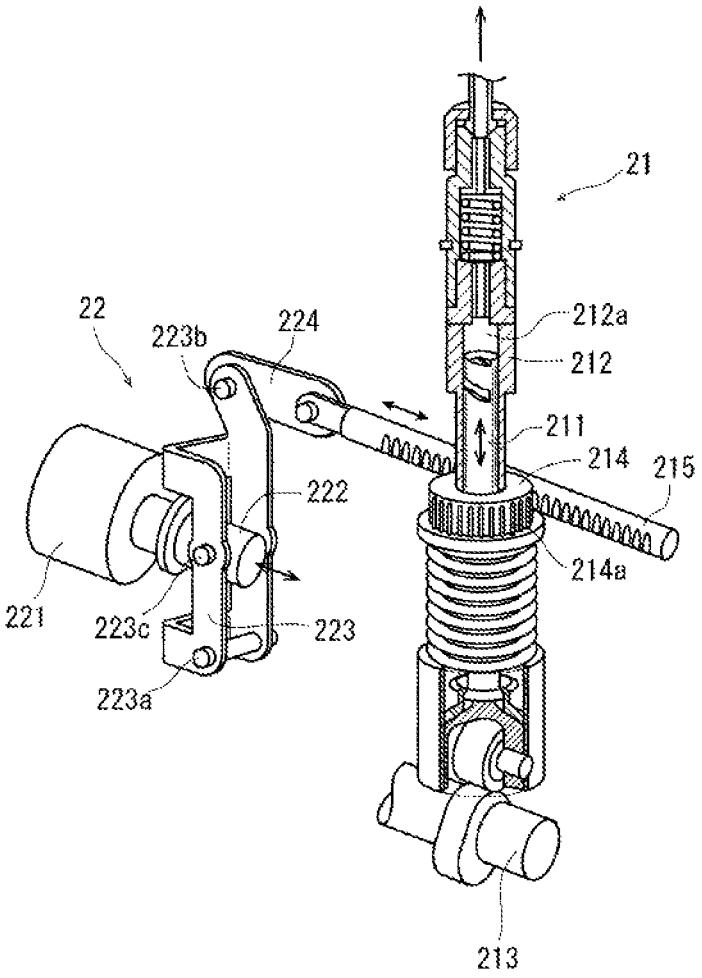
FIG. 3 A schematic drawing illustrating an internal configuration of a fuel pressurization mechanism disposed in the fuel injection pump illustrated in FIG. 2.

The fuel pressurization mechanisms 21 will be described with reference to FIG. 3 in addition to FIG. 2. As illustrated in FIG. 3, each of the fuel pressurization mechanisms 21 is constituted by: a pumping section including, for example, a plunger 211, a plunger barrel 212, and the cam shaft 213; and an amount adjusting section including a control sleeve 214 and a control rack (hereinafter referred to as a "rack") 215.

The rack 215 constituting the amount adjusting section is operated by a rack driving means (hereinafter referred to as a "rack actuator") 221 that is included in the governor mechanism 22 and configured to operate electrically. Operation of a retreatable member 222 of the rack actuator 221 is transferred to an end portion of the rack 215 through a linkage mechanism 223. A lower end portion 223*a* of the linkage mechanism 223 is pivotally supported by a fixed shaft at the governor case 2*b*, and an upper end portion 223*b* of the linkage mechanism 223 is pivotally supported by an end portion of the rack 215 through a sub-link 224. A front end of the retreatable member 222 of the rack actuator 221 is pivotally supported by a substantially midportion 223*c* of the linkage mechanism 223. When the retreatable member 222 is retreated, the rack 215 is thereby driven along the directions indicated by arrows in the drawing.

The fuel pressurization mechanisms 21 pump fuel in such a manner that the substantially cylindrical plunger 211 slidably fitted in a barrel hole 212*a* formed in the plunger barrel 212 is caused to slide upward and downward by rotation of the cam shaft 213 below the plunger 211.

The control sleeve 214 that rotates about an axis of the plunger 211 together with the plunger 211 is fitted onto an axially intermediate portion of the plunger 211. A pinion 214*a* disposed at the outer periphery of the control sleeve 214 meshes with the rack 215 orthogonal to the axial direction of the plunger 211. As described above, the rack 215 is coupled to the rack actuator 221 through, for example, the linkage mechanism 223. A rack control signal from an engine speed control device 30 described later is supplied to a driving device 25 so that the rack actuator 221 is thereby controlled.

As described above, the control sleeve 214 is rotated by operating the rack 215, and the timing of start of discharge by the plunger 211 and a timing of completion of the discharge are changed, thereby enabling target fuel injection. As illustrated in the drawing, the driving device 25 is coupled to the rack actuator 221 through the governor case 2*b*. The driving device 25 includes an unillustrated rack position detecting means (hereinafter referred to as a "rack sensor") for detecting an operating position of the rack 215 and a driver circuit for supplying a desired driving current to the rack actuator 221, for example. The driving device 25 is operated to control the operation amount of the rack actuator 221 so that the rack 215 can be controlled to a desired position. The phenomenon in which the timing of start of fuel discharge by the plunger 211 and the timing of completion of the discharge are changed by rotating the control sleeve 214 by the rack 215 is a technical matter commonly known for those skilled in the art as a configuration of an in-line fuel injection pump. Thus, detailed description will not be given.

The radiator 3 is a so-called heat exchanger that cools cooling water heated by the diesel engine 100. The radiator 3 performs heat exchange of cooling water passing through the inside of the radiator 3 by sending air from an air-cooling fan 16 that is disposed in the engine body 1 and rotated by a rotation driving force taken from the unillustrated crankshaft. The cooling water is circulated by a cooling water pump 17 disposed in the engine body 1. After being cooled by the radiator 3, the cooling water passes through a cooling water inlet hose 3*a* leading to the engine body 1 and is sent to an unillustrated cooling water passage in the engine body 1 through the cooling water pump 17. Cooling water heated through the cooling water passage in the engine body 1 passes through a cooling water outlet hose 3*b* by way of the cooling water pump 17 and is returned to the radiator 3.

The cooling water pump 17 is provided with an unillustrated thermostat, and is configured such that if the engine body 1 is at a temperature less than or equal to a predetermined temperature as a threshold for determining whether the engine body 1 is in a cold/hot state or not, cooling water is not caused to flow toward the radiator 3 but is returned to a cooling water passage of the engine body 1 without change. With this configuration, if the diesel engine 100 is in a cold state, cooling water is heated quickly, and the state is quickly shifted to a hot state. After having reached the hot state, the cooling water temperature is kept at a constant temperature.

The diesel engine 100 of this embodiment is generally configured as described above. A configuration in which the engine speed control device 30 disposed in the diesel engine 100 controls an engine speed in accordance with the cold/hot state of the diesel engine 100 will be more specifically described.

The engine speed control device 30 is constituted by a computer, and includes a central processing unit (CPU) that performs a computation process according to a control program, a read-only memory (ROM) for storing the control program and maps described later, for example, a read/write random-access memory (RAM) for temporarily storing detection values detected by detection means and computation results, for example, an input interface, and an output interface (not specifically shown). The water temperature sensor 1*a*, the engine oil temperature sensor 1*b*, the pump oil temperature sensor 23, the engine speed sensor 24, the driving device 25, an accelerator pedal 6, and so forth, are electrically connected to the engine speed control device 30.

The engine speed control of the diesel engine 100 is divided into a start mode applied to a state from when a starter motor is started by being turned on from an engine stopped state by an operator to when the engine speed reaches a start determination engine speed (e.g., 900 rpm) and an operation mode applied to a normal operation after the engine speed has reached the start determination engine speed. The start determination engine speed is generally set at a level higher than a target idle engine speed in the operation mode, and no feedback control of the engine speed is performed in the start mode.

In the combustion chamber space of the engine body 1, an unillustrated glow plug is disposed to face the vicinity of the fuel injection nozzle 13. When the engine is turned on by the operator, the cold/hot state is determined in accordance with a detected value of the water temperature sensor 1*a* of the engine body 1, and a conducting time of the glow plug before the crankshaft is rotated by the starter motor and after the start of operation is controlled. When electric power is supplied to the glow plug, the surface temperature of the glow plug is increased to about 800 to 900° C.

In the start mode, in accordance with the detected value of the water temperature sensor 1*a*, a fuel injection timing is set at a time a predetermined period before the piston 12 reaches a top dead center, and in addition, the fuel injection amount is increased. The conducting time of the glow plug, the fuel injection start timing, and the amount of increase in fuel injection are defined in a start control map (not shown) using a cooling water temperature, a fuel injection start time, and a fuel injection amount as parameters previously by experiments. Startability in the start mode is optimized by referring to the start control map stored in the engine control means 30 as appropriate. The start determination engine speed may be changed in accordance with the cooling water temperature, and may be set in such a manner that the start determination engine speed increases as the cooling water temperature decreases. The change in the fuel injection timing and the increase in the fuel injection amount in the start mode are performed by rotating the control sleeve 214 by the rack 215.

When the start mode is started by a turn-on operation of the operator so that an actual engine speed Nr detected from the engine speed sensor 24 reaches the start determination engine speed described above, the start mode is finished and shifts to the operation mode. After the shift to the operation mode, feedback control to which PID control configured based on an embodiment of the present invention is performed so that the actual engine speed Nr matches the target engine speed Nm.

Figure 4:
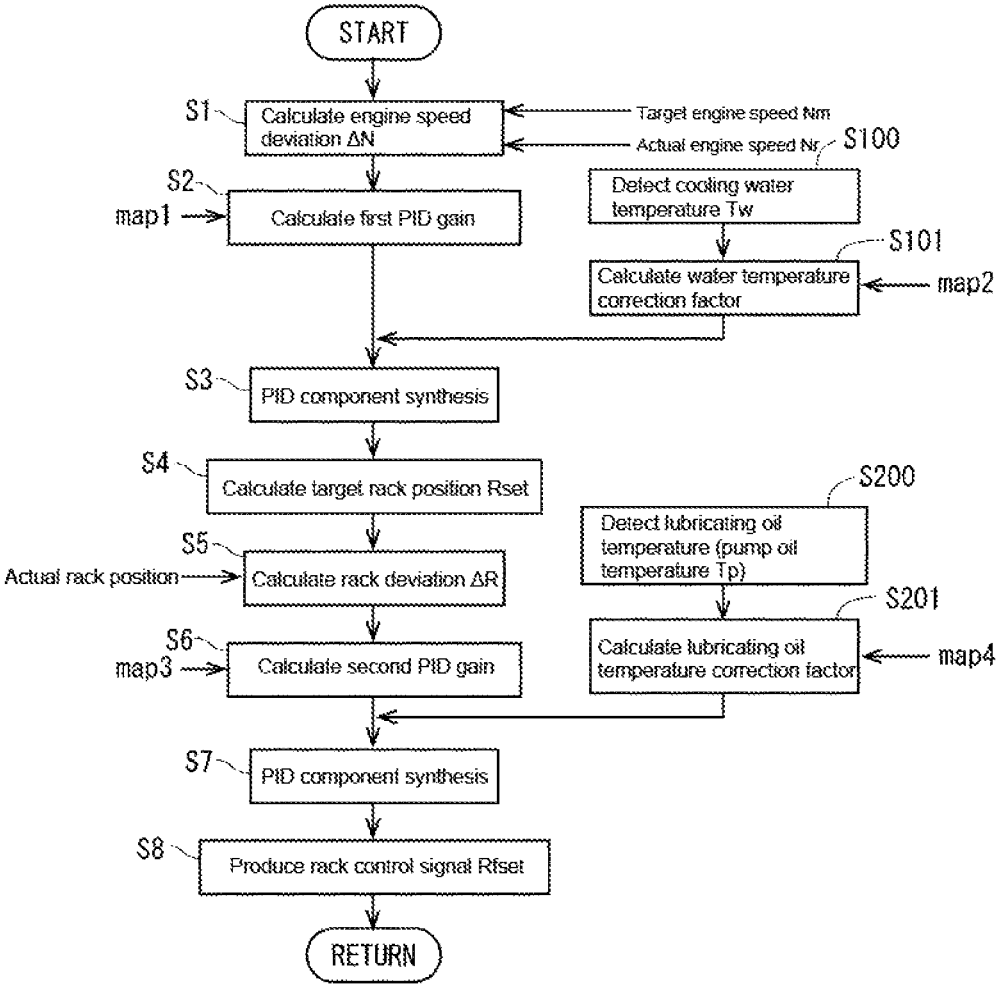
FIG. 4 A chart depicting a control flow of engine control performed by an engine control device configured according to an aspect of the present invention.

FIG. 4 illustrates a control flow of engine speed control in the operation mode. When the start mode shifts to the operation mode, an engine speed deviation ΔN between a target engine speed Nm calculated in accordance with the operating state and an actual engine speed Nr detected by the engine speed sensor 24 is calculated (step S1). The target engine speed Nm is calculated and set in accordance with the opening degree of an accelerator 6 operated by an operator and a load of a work machine, for example. The target engine speed Nm herein may be set by, for example, an accelerator lever or a dial operated by an operator and used for setting an engine speed, and a method for setting the target engine speed Nm is not limited to the setting method described above.

Once the engine speed deviation ΔN is calculated by performing step S1, reference is made to a first gain map (map1) using as parameters a target engine speed Nm and an engine speed deviation ΔN as shown in FIG. 5. The first gain map (map1) is previously set by, for example, experiments, and as shown in FIG. 5, the target engine speed Nm is divided into Nm(0) through Nm(max), and the engine speed deviation ΔN corresponding to the target engine speed Nm is divided into ΔN(min) through ΔN(max). For example, first PID gains (K1p(x), K1i(x), K1d(x)) corresponding to the target engine speed Nm(x) and the engine speed deviation ΔN(x) are set. Specifically, when the target engine speed Nm is set, and the engine speed deviation ΔN is calculated, reference is made to the first gain map (map1), and first PID gains (K1p, K1i, K1d) corresponding to the target engine speed Nm and the engine speed deviation ΔN are calculated (first PID gain calculation step: step S2). The ΔN(min) is set on the assumption that the actual engine speed Nr is significantly high relative to the target engine speed Nm (negative value), and ΔN(max) is set on the assumption that the actual engine speed is significantly low relative to the target engine speed Nm (positive value). In the first PID gains described above, a first proportional gain K1p is a control constant set in proportion to the engine speed deviation ΔN, a first integration gain K1i is a control constant set in proportion to a time integral value of the engine speed deviation ΔN, and a first differentiation gain K1d is a control constant set in proportion to a time differentiation value of the engine speed deviation ΔN.

The first PID gains (K1p, K1i, K1d) are calculated by performing step S2, whereas a water temperature correction factor necessary for calculating a target rack position Rset is calculated. More specifically, a cooling water temperature Tw is detected at every predetermined time (e.g., every several ms) (step S100), and reference is made to a water temperature correction map (map2) previously set by, for example, experiments as shown in FIG. 6. The water temperature correction map (map2) is divided into cooling water temperatures Tw(0) through Tw(max), and water temperature correction factors (ε1p(x), ε1i(x), ε1d(x)) corresponding to the cooling water temperature Tw(x) are set, for example. Thus, by referring to the water temperature correction map (map2), the water temperature correction factors (ε1p, ε1i, ε1d) corresponding to the cooling water temperature Tw are calculated (step S101).

The water temperature correction factors (ε1p, ε1i, ε1d) are updated at every predetermined time when the cooling water temperature Tw is detected, and are stored in the engine speed control device 30 in accordance with a change in the cooling water temperature Tw. The water temperature correction factors (ε1p, ε1i, ε1d) are set in consideration of a phenomenon that followability of feedback control in the engine speed control degrades as the cooling water temperature Tw of the engine decreases.

Once the first PID gains (K1p, K1i, K1d) are calculated, PID synthesis is performed. More specifically, a rack control amount corresponding to a proportional operation is expressed by u1(p)=K1p·e, a rack control amount corresponding to an integration operation is expressed by u1(i) =K1i∫edt, and a rack control amount corresponding to the differentiation operation is expressed by u1(d)=K1d·de/dt, where e represents a position deviation amount using the engine speed deviation ΔN as a position deviation of the control rack 215. By multiplying the rack control amounts by the water temperature correction factors (ε1p, ε1i, ε1d), PID synthesis for calculating the target rack position Rset is performed as equation (1) (step S3).

$$\text{PID synthesis}=\varepsilon 1p\cdot u1(p)+\varepsilon 1i\cdot u1(i)-\varepsilon 1d\cdot u1(d) \quad (1)$$

Once PID synthesis is executed by equation (1) above, a target rack position Rset as a target position of the rack 215 for canceling the engine speed deviation ΔN is calculated based on equation (2) (target rack position calculation step: step S4).

$$R\text{set}=\alpha\cdot[\text{equation}(1)]+R\text{id}1 \quad (2)$$

In equation (2), α is a coefficient for replacing the PID gain obtained by the PID synthesis (equation (1)) with a target rack position Rset to be a target of the rack 215, and is a value appropriately set in accordance with, for example, characteristics of the fuel injection pump 2 to be used. In addition, Rid1 is an idle rack reference position serving as a reference assumed in an idle operation. Since the idle rack reference position Rid1 is introduced in calculation of the target rack position Rset, the start mode can smoothly shift to the operation mode, and a significant rotation fluctuation can be reduced. In this embodiment, in calculating the target rack position Rset by equation (2), the idle rack reference position Rid1 is used. However, the invention is not limited to this, and another value may be used as appropriately in consideration of controllability. For example, in the case of a low engine temperature or the case of a large engine speed deviation in shifting from the start mode to the operation mode, a value larger than the idle rack reference position Rid1 may be set.

Once the target rack position Rset is calculated in step S4, a current actual rack position Rr is detected by a sensor (not shown) included in the driving device 25 of the fuel injection pump 2, and a rack deviation ΔR between the target rack position Rset and the actual rack position Rr is calculated (step S5).

Once the rack deviation ΔR is calculated by executing step S5, reference is made to a second gain map (map3). The second gain map (map3) is previously set by, for example, experiments, and as shown in FIG. 7, the target rack position Rset is divided into Rset(0) through Rset(max), and the rack position deviation ΔR corresponding to the target rack position Rset is divided into ΔR(min) through ΔR(max). For example, second PID gains (K2p(x), K2i(x), K2d(x)) corresponding to the target rack position Rset(x) and the rack position deviation ΔR(x) are set. That is, once the target rack position Rset is set and the rack position deviation ΔR is calculated, reference is made to the second gain map (map3), and second PID gains (K2p, K2i, K2d) corresponding to the target rack position Rset and the rack position deviation ΔR are calculated (second PID gain calculation step: step S6). In the second PID gains described above, a second proportional gain K2p is a control constant set in proportion to the rack position deviation ΔR, a second integration gain K2i is a control constant set in proportion to a time integral value of the rack position deviation ΔR, and a second differentiation gain K2d is a control constant set in proportion to a time differentiation value of the rack position deviation ΔN.

The second PID gains (K2p, K2i, K2d) are calculated by performing step S6, whereas a lubricating oil temperature correction factor necessary for calculating a final rack control signal Rfset is calculated. In this embodiment, a pump oil temperature Tp detected by the pump oil temperature sensor 23 disposed in the fuel injection pump 2 is used as an engine lubricating oil temperature. The pump oil temperature Tp is detected at every predetermined time (e.g., every several ms) (step S200), and reference is made to a lubricating oil correction map (map4) as shown in FIG. 8 which is previously set by experiments for example. The lubricating oil correction map (map4) is divided into pump oil temperatures Tp(0) through Tp(max), and lubricating oil temperature correction factors (ε2p(x), ε2i(x), ε2d(x)) corresponding to the pump oil temperature Tp(x) are set. Thus, by referring to the lubricating oil correction map (map4), lubricating oil temperature correction factors (ε2p, ε2i, ε2d) for correcting the second PID gains (K2p, K2i, K2d) corresponding to the detected pump oil temperature Tp are calculated (step S201).

In this embodiment, the value detected from the pump oil temperature sensor 23 of the fuel injection pump 2 is used as the lubricating oil temperature for calculating lubricating oil temperature correction factors. However, the present invention is not limited to this example. A lubricating oil temperature detected by the engine oil temperature sensor 1*b* disposed in the engine body 1 may be used. To reflect the operating state of the rack 215 of the fuel injection pump 2 on engine speed control more accurately, the pump oil temperature Tp for detecting a temperature of a place close to the rack 215 is preferably used.

The lubricating oil temperature correction factors (c2p, c2i, c2d) are updated at every predetermined time when the pump oil temperature Tp is detected, and is stored in the engine speed control device 30 in accordance with a change in the pump oil temperature Tp. The lubricating oil temperature correction factors (ε2p, ε2i, ε2d) are set in consideration of a phenomenon that as the lubricating oil temperature of the fuel injection pump 2 decreases, the viscosity of lubricating oil increases, and an operating resistance of the rack 215 increases accordingly so that followability of feedback control degrades.

As a result of calculating the second PID gains (K2p, K2i, K2d) described above, a rack control amount corresponding to the proportional operation is expressed by u2(p)=K2p·e', a rack control amount corresponding to the integration operation is expressed by u2(i)=K2i∫e'dt, and a rack control amount corresponding to the differentiation operation is expressed by u2(d)=K2d·de'/dt, where e' represents a position deviation amount between the target rack position Rset and the actual rack position Rr of the rack 215. Then, PID synthesis for correction by multiplying the rack control amounts by the lubricating oil temperature correction factors (ε2p, ε2i, ε2d) is performed as expressed by equation (3) (step S7).

$$\text{PID synthesis}=\varepsilon 2p\cdot u2(p)+\varepsilon 2i\cdot u2(i)-\varepsilon 2d\cdot u2(d) \quad (3)$$

Once PID synthesis is performed by equation (3), a rack control signal Rfset providing a final target position of the rack 215 for canceling the rack position deviation ΔR described above is produced based on equation (4) (rack control signal producing step: step S8).

$$Rf\text{set}=\beta\cdot[\text{equation}(3)]+Rid1 \quad (4)$$

In equation (4), β is a coefficient for replacing the gains obtained by the PID synthesis of equation (3) with a final rack control signal Rfset of the rack 215, and is a coefficient appropriately set in accordance with, for example, characteristics of the fuel injection pump 2 to be used. In addition, Rid1 is an idle rack reference position of the rack 215 serving as a reference applied in an idle operation.

Once the rack control signal Rfset is calculated by equation (4) described above, a rack control signal Rfset is supplied to the driving device 25 from the engine speed control device 30, and a driving current in accordance with the rack control signal Rfset is supplied to the rack actuator 221 so that the position of the rack 215 is controlled.

While the operation mode is being executed, the control flow depicted in FIG. 4 is repeated. Accordingly, the first PID gain calculation step, the target rack position calculation step, the second PID gain calculation step, and the rack control signal producing step are performed in order, the rack signal is controlled based on the produced rack control signal, and feedback control is performed such that the engine speed converges to the target engine speed.

The present invention is not limited to the embodiments described above, and various embodiments are conceivable as long as these embodiments are included in a technical range of the invention. For example, in the embodiment, one map is used as each of the first gain map (map1), the second gain map (map3), the water temperature correction map (map3), and the lubricating oil correction map (map4). However, engine speed control is not necessarily performed with one map, and a map for a cold state and a map for a hot state may be produced for each map so that these maps can be selectively used in accordance with the operating state. Accordingly, engine speed control can be more finely performed in accordance with the cold/hot state of the engine so that the engine speed can be caused to converge to the target engine speed more quickly.

In the embodiment described above, in calculating the first PID gains, the second PID gains, the water temperature correction factor, and the lubricating oil temperature correction factor, a map for calculating each value is previously produced, and the value is calculated by referring to the map. However, each map is not necessarily produced beforehand for reference. For example, an arithmetic expression using a parameter for defining each map as a variable may be previously produced so that each value can be calculated based on the arithmetic expression. In particular, since one parameter is used for calculating a correction factor for each of the water temperature correction factor and the lubricating oil temperature correction factor, arithmetic expressions for calculating these correction factors can be easily set. If a correction factor is set by an arithmetic expression, a memory capacity of the engine speed control device can be saved.

In the embodiment, the first PID gains are corrected based on the cooling water temperature Tw to thereby calculate the target rack position Rset of the fuel injection pump 2. However, the present invention is not limited to correction of the first PID gains based only on the cooling water temperature Tw. Various parameters are known as parameters referred to in controlling an engine speed. The present invention may include correction based on, for example, a lubricating oil temperature of the engine body, a temperature of intake air sucked in the cylinder, an atmospheric pressure, and a fuel temperature in a fuel tank in addition to the cooling water temperature.

In a manner similar to the first PID gains, for the second PID gains, the present invention is not limited to correction based only on the actual lubricating oil temperature detected by the lubricating oil temperature detecting means, and further correction based on, for example, a cooling water temperature of the engine body, a temperature of intake air sucked in the cylinder, an atmospheric pressure, and a fuel temperature in the fuel tank may be included in addition to the correction based on the lubricating oil temperature.

REFERENCE SIGNS LIST

1: engine body
1*a*: cooling water temperature detecting means (water temperature sensor)
1*b*: lubricating oil temperature detecting means (engine oil temperature sensor)
2: fuel injection pump
2*a*: pump case
2*b*: governor case
3: radiator
3*a*: cooling water inlet hose
3*b*: cooling water outlet hose
4: fuel tank
4*a*: fuel supply passage
4*b*: fuel return passage
6: accelerator
11: cylinder
12: piston
13: fuel injection nozzle
21: fuel pressurization mechanism
211: plunger
212: plunger barrel
213: cam shaft
214: control sleeve
215: control rack (rack)
22: governor mechanism
221: rack driving means (rack actuator)
222: rod
223: linkage mechanism
224: sub-link
23: lubricating oil temperature detecting means (pump oil temperature sensor)
24: engine speed detecting means (engine speed sensor)
25: driving device
30: engine speed control device
100: diesel engine

The invention claimed is:

1. An engine speed control device for an engine, the engine speed control device at least comprising:

an engine speed detecting means configured to detect an engine speed of the engine;

a cooling water temperature detecting means configured to detect a temperature of a cooling water of the engine;

a rack position detecting means configured to detect a rack position of a fuel injection pump; and a lubricating oil temperature detecting means configured to detect a lubricating oil temperature of the engine, wherein:

the engine speed control device is configured to perform:

a first PID gain calculation step of calculating a target engine speed to calculate a first PID gain based on an engine speed deviation between the target engine speed and an engine speed detected by the engine speed detecting means, a target rack position calculation step of correcting the first PID gain using a cooling water temperature correction factor based on a cooling water temperature detected by the cooling water temperature detecting means to thereby calculate a target rack position of the fuel injection pump, a second PID gain calculation step of calculating a second PID gain based on a rack position deviation between the target rack position and a rack position detected by the rack position detecting means, and a rack control signal producing step of correcting the second PID gain using a lubricating oil temperature correction factor based on a lubricating oil temperature detected by the lubricating oil temperature detecting means to thereby produce a rack control signal;

the engine speed control device is further configured to control the engine speed by controlling the rack position based on the rack control signal;

the cooling water temperature correction factor applied to correction of the first PID gain is prevented from being applied to correction of the second PID gain; and the lubricating oil temperature correction factor applied to correction of the second PID gain is prevented from being applied to correction of the first PID gain.

2. The engine speed control device according to claim 1, wherein the lubricating oil temperature detecting means is disposed in a fuel injection pump and is configured to detect a lubricating oil temperature of the fuel injection pump.

* * * * *